US010293362B2

(12) United States Patent
Beckett

(10) Patent No.: US 10,293,362 B2
(45) Date of Patent: May 21, 2019

(54) MULTICOMPONENT DISPENSER

(71) Applicant: Sulzer Mixpac AG, Haag (CH)

(72) Inventor: Clifford Edward Beckett, Berkshire (GB)

(73) Assignee: SULZER MIXPAC AG, Haag (CH)

( * ) Notice: Subject to any disclaimer, the term of this patent is extended or adjusted under 35 U.S.C. 154(b) by 0 days.

(21) Appl. No.: 15/880,778

(22) Filed: Jan. 26, 2018

(65) Prior Publication Data

US 2018/0147598 A1 May 31, 2018

Related U.S. Application Data

(63) Continuation of application No. 14/796,479, filed on Jul. 10, 2015, now Pat. No. 9,914,148.

(30) Foreign Application Priority Data

Jul. 15, 2014 (GB) ..... 1412530.6

(51) Int. Cl.
*B05C 17/01* (2006.01)
*B05C 17/005* (2006.01)

(52) U.S. Cl.
CPC .... *B05C 17/0103* (2013.01); *B05C 17/00566* (2013.01); *B05C 17/00583* (2013.01); *B05C 17/00596* (2013.01)

(58) Field of Classification Search
CPC ..... B05C 17/0103; B05C 17/00566; B05C 17/00583; B05C 17/00596
(Continued)

(56) References Cited

U.S. PATENT DOCUMENTS 4,871,090 A 10/1989 Hoffman
4,949,873 A 8/1990 Maeder
(Continued)

FOREIGN PATENT DOCUMENTS

DE 10322932 A1 12/2004
EP 0294672 A1 12/1988
(Continued)

OTHER PUBLICATIONS

Application and File history for U.S. Appl. No. 11/886,029, filed Feb. 21, 2008. Inventors: Beckett et al.
(Continued)

*Primary Examiner* — Lien M Ngo
(74) *Attorney, Agent, or Firm* — Global IP Counselors, LLP

(57) ABSTRACT

A dispenser for mixing and dispensing a multi-component adhesive or sealant includes a first motor operably coupled to two or more plungers, each plunger being slidably disposed in a respective one of two or more barrels and configured to apply a dispensing pressure to respective materials to be dispensed, a second motor operably coupled to an output drive shaft having a mating end, and a coupling plate removably attached to a front end of the dispenser, the coupling plate configured to attach to a disposable mixer attachment configured to mix and dispense the multi-component adhesive or sealant, the disposable mixer attachment having a drive shaft driving a mixing component and configured to selectively couple with the mating end of the output drive shaft of the second motor, thereby enabling dynamic mixing of the respective materials to be dispensed.

13 Claims, 3 Drawing Sheets

(58) Field of Classification Search
USPC ..... 222/145.6, 145.5, 137, 333, 63
See application file for complete search history.

(56) References Cited

U.S. PATENT DOCUMENTS

| | | | | |
|---|---|---|---|---|
| 4,981,241 | A | 1/1991 | Keller | |
| 5,228,599 | A | 7/1993 | Keller | |
| 6,311,871 | B1 | 11/2001 | Binder | |
| 6,457,609 | B1 | 10/2002 | Keller | |
| 6,769,574 | B1 | 8/2004 | Keller | |
| 6,854,349 | B2 | 2/2005 | Brandhorst | |
| 6,932,237 | B2 | 8/2005 | Heymann | |
| 6,988,822 | B2 * | 1/2006 | Leung | A47J 43/082 366/129 |
| D606,819 | S | 12/2009 | Beckett | |
| D636,091 | S | 4/2011 | Brummitt | |
| 7,959,039 | B2 | 6/2011 | Beckett | |
| 7,980,428 | B2 | 7/2011 | Beckett | |
| D660,105 | S | 5/2012 | Brummitt | |
| D660,663 | S | 5/2012 | Brummitt | |
| D673,020 | S | 12/2012 | Brummitt | |
| 8,499,977 | B2 | 8/2013 | Hughes | |
| 8,528,793 | B2 | 9/2013 | Brummitt | |
| 8,607,824 | B2 | 12/2013 | Brummitt | |
| 8,616,415 | B2 | 12/2013 | Brummitt | |
| 8,870,093 | B2 | 10/2014 | Brummitt | |
| 9,397,596 | B2 | 7/2016 | Baker | |
| 2002/0175186 | A1 | 11/2002 | Keller | |
| 2004/0184347 | A1 * | 9/2004 | Leung | A47J 43/082 366/129 |
| 2006/0027605 | A1 | 2/2006 | Beckett et al. | |
| 2008/0128454 | A1 | 6/2008 | Beckett | |
| 2009/0039113 | A1 | 2/2009 | Hsu et al. | |
| 2010/0091607 | A1 | 4/2010 | Meyer et al. | |
| 2010/0252574 | A1 | 10/2010 | Busin | |
| 2011/0292757 | A1 * | 12/2011 | Cheio De Oliveira | B01F 7/30 366/272 |
| 2012/0048893 | A1 | 3/2012 | Beckett | |
| 2014/0036616 | A1 | 2/2014 | Ghosh | |
| 2015/0150416 | A1 * | 6/2015 | Hoare | A47J 43/0711 366/344 |
| 2015/0265088 | A1 * | 9/2015 | Thomas | A47J 19/04 241/89.1 |
| 2015/0266050 | A1 | 9/2015 | Beckett et al. | |
| 2016/0016195 | A1 | 1/2016 | Beckett | |

FOREIGN PATENT DOCUMENTS

| | | | |
|---|---|---|---|
| EP | 0302819 | A2 | 2/1989 |
| EP | 0304493 | A1 | 11/1989 |
| EP | 0467830 | A1 | 1/1992 |
| FR | 2929537 | A1 | 10/2009 |
| GB | 2415950 | A | 1/2006 |
| WO | 2008131996 | A1 | 11/2008 |
| WO | 2009071318 | A2 | 6/2009 |

OTHER PUBLICATIONS

Search Report dated Jun. 19, 2006 for PCT Application No. PCT/GB2006/000847, 2 pages.

Search Report dated Mar. 10, 2016 for EP Application No. 15176934.6, 12 pages.

GB Search Report dated Jan. 20, 2015 for GB Application No. 1412530.6, 1 page.

* cited by examiner

MULTICOMPONENT DISPENSER

CROSS-REFERENCE TO RELATED APPLICATION

The present application is a continuation of U.S. patent application Ser. No. 14/796,479, filed on Jul. 10, 2015, which claims priority to GB Application No. 1412530.6 filed Jul. 15, 2014, the contents of each of which are hereby incorporated herein by reference.

BACKGROUND

Field of the Invention

The present invention relates to an electrically powered dispenser for dispensing a mixture of viscous materials, for example for dispensing a two-component adhesive or sealant.

Background of the Invention

Known electrically powered multicomponent dispensers use a so called passive mixer attachment to mix the separately held components during the dispensing process. A passive mixer mixes the component as they flow through the mixer attachment, for example by the provision of material interleaving vanes, without dynamically driven components inside the mixer attachment. Passive mixers have the advantage of simplicity due to the absence of driven components and movable parts but, in particular where mixing ratios are high, such as 10:1 or larger, a long mixing flow path, and hence a long mixer attachment is required. Dynamic mixers have dynamically driven components inside the mixer attachment which actively interleave the materials as they flow through the mixer attachment. Advantageously, the increased mixing due to the active interleaving enables the length of the mixer attachment to be reduced. However, this comes at a price of added complexity as provisions have to be made for driving the components of the mixer attachment.

It is desirable to provide an electrically powered mixer/dispenser for dispensing and mixing viscous materials that combines the advantages of known electrically powered multicomponent dispensers with dynamic mixing in an efficient manner.

SUMMARY

Aspects of the invention are set out in the independent claims. A dispenser for dispensing a mixture of viscous materials is provided, which has separate respective electric motors which drive a dispensing mechanism for dispensing the materials and a mixing mechanism for driving a dynamic mixer attachment. Advantageously, providing separate motors for each task provides a simple construction of the dispenser as each motor can be located close to the respective driven mechanism and can be controlled independently.

In some embodiments, the mixer attachment is a disposable dynamic mixer attachment. Examples of such disposable mixers are well known in the art.

In some embodiment, the dispenser is a handheld dispenser. The dispenser may define a handle portion to enable a user to hold the dispenser by gripping the handle in order to operate the dispenser as a handheld dispenser. The handle may be defined by a stock portion, which also houses the electric motor driving the dispensing mechanism.

In some embodiments, the motor driving the mixing mechanism may be secured, housed or disposed at a front end of the dispenser, adjacent where the mixer attachment is attached to the dispenser.

In some embodiments, the material to be dispensed is held relative to the dispensing mechanism by respective barrels that are part of the dispenser. At one end, the barrels are configured so as to enable the dispensing mechanism to engage the material and at the other end they are sealed by a mixer holder that provides a conduit from each barrel to an inlet of the mixer attachment. Such a dispenser can accommodate a foil pack ("sausage pack") or bulk material, with a plunger of the dispensing mechanism directly engaging the foil pack or bulk material. In other embodiments, the dispenser is arranged to accept a cartridge providing the material holding barrels and a plunger of the dispensing mechanism is arranged to engage a piston inside the cartridge barrels to dispense the materials, with the mixer holder ensuring a sealing engagement between inlet ports of the mixer attachment and corresponding outlet ports of the cartridge.

In some embodiments, the dispenser comprises a controller arranged to control the operation of the respective motors to control dispensing and mixing. For example, in some embodiments, a dispensing action is controlled by a trigger provided on the dispenser. Actuation by a user of the trigger results in material being dispensed and mixed. Specifically, in some embodiments, the motor actuating the dispensing mechanism is controlled as a variable speed motor, with the degree of actuation of the trigger controlling the speed of operation of the motor and thus the dispensing speed. In some embodiments, the motor actuating the mixing mechanism is controlled as a fixed speed motor, operating the mixing mechanism at a fixed speed as soon as the trigger is actuated. In some embodiments, the motor actuating the dispensing mechanism is a variable speed motor and the motor actuating the mixer mechanism is a fixed speed motor.

BRIEF DESCRIPTION OF THE DRAWINGS

The invention will be explained in more detail hereinafter with reference to the drawings.

DETAILED DESCRIPTION OF THE EMBODIMENTS

Figure 1:
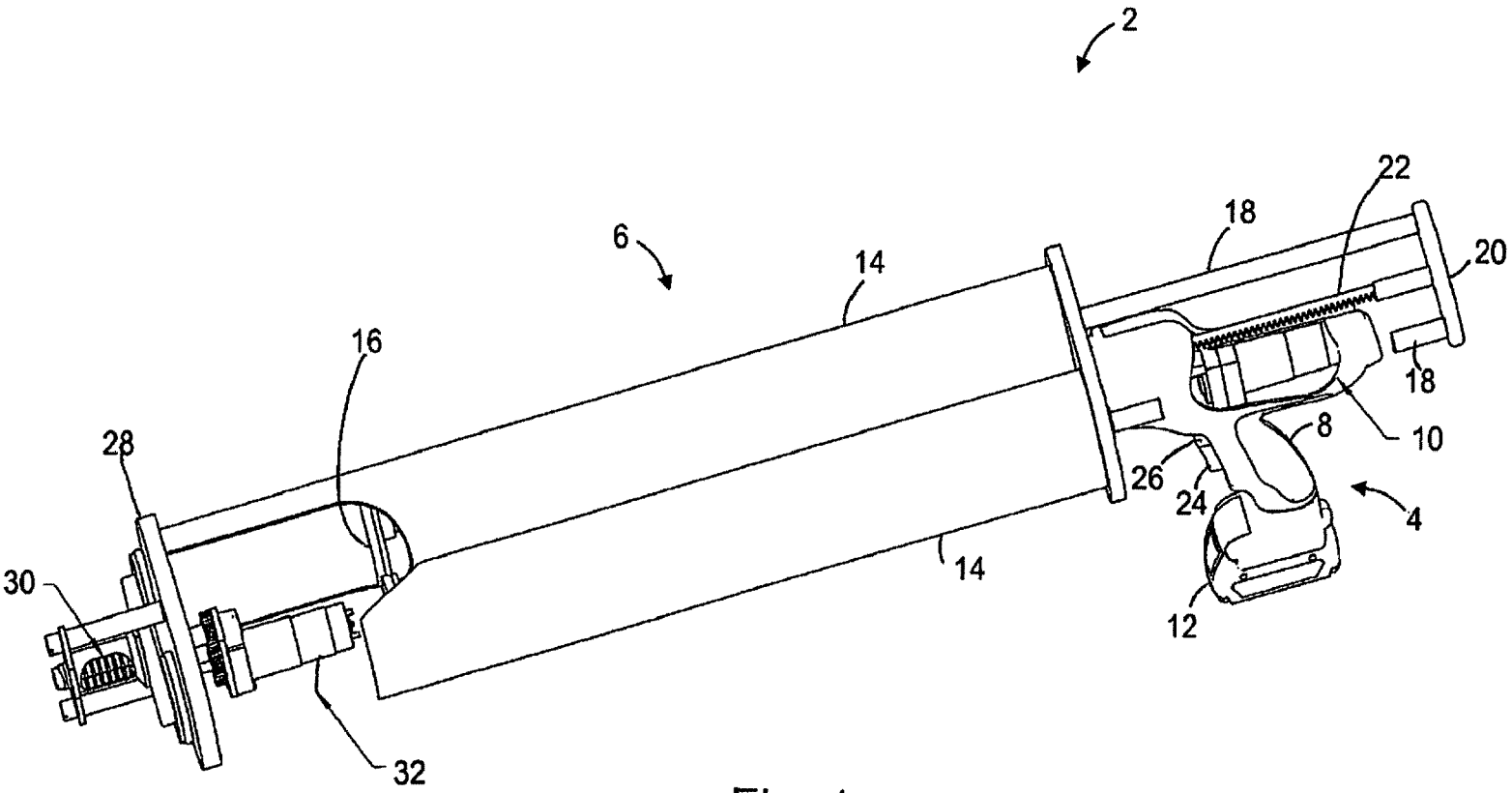
FIG. 1 illustrates a dispenser in a partially cut-away view.

With reference to FIG. 1, a dispenser 2 comprises a stock portion 4 and a holder portion 6. The stock portion 4 comprises a handle 8 for holding by a user. The stock portion 4 houses a motor 10 and has secured to it a battery pack 12 for powering the motor 10. The holder portion 6 comprises two barrels 14 secured to the stock portion, for containing respective materials to be dispensed, for example in the form of a foil pack. A plunger 16 attached to a push rod 18 is disposed slidably in each barrel 14. The push rods 18 are linked at a rear end of the dispenser by a cross rod 20, which also links the push rods 18 to a rack 22 driven by the motor 10 via a pinion and gear arrangement (not shown in FIG. 1). A dispensing trigger 24 actuates the motor 10 to advance the rack 22 and push rods 18 to apply a dispensing pressure via the plungers 16 to the materials to be dispensed by advancing the plungers 16 inside their respective barrels 14. A reverse trigger 26 is provided to initiate reverse operation of the motor to retract the rack 22, push rod 18 and plunger 16 inside the barrel to allow the dispenser to be refilled.

A coupling plate 28 seals the barrels 14 at a front end of the dispenser and provides a fluidic path from the inside of the sealed barrels 14 to a mixer attachment 30, as will be described in detail below. A further motor 32 is housed by the holder portion 6, disposed at the front end of the holder portion 6, for driving a mixer mechanism that is coupled to the mixer attachment when the mixer attachment is in place.

Figure 2:
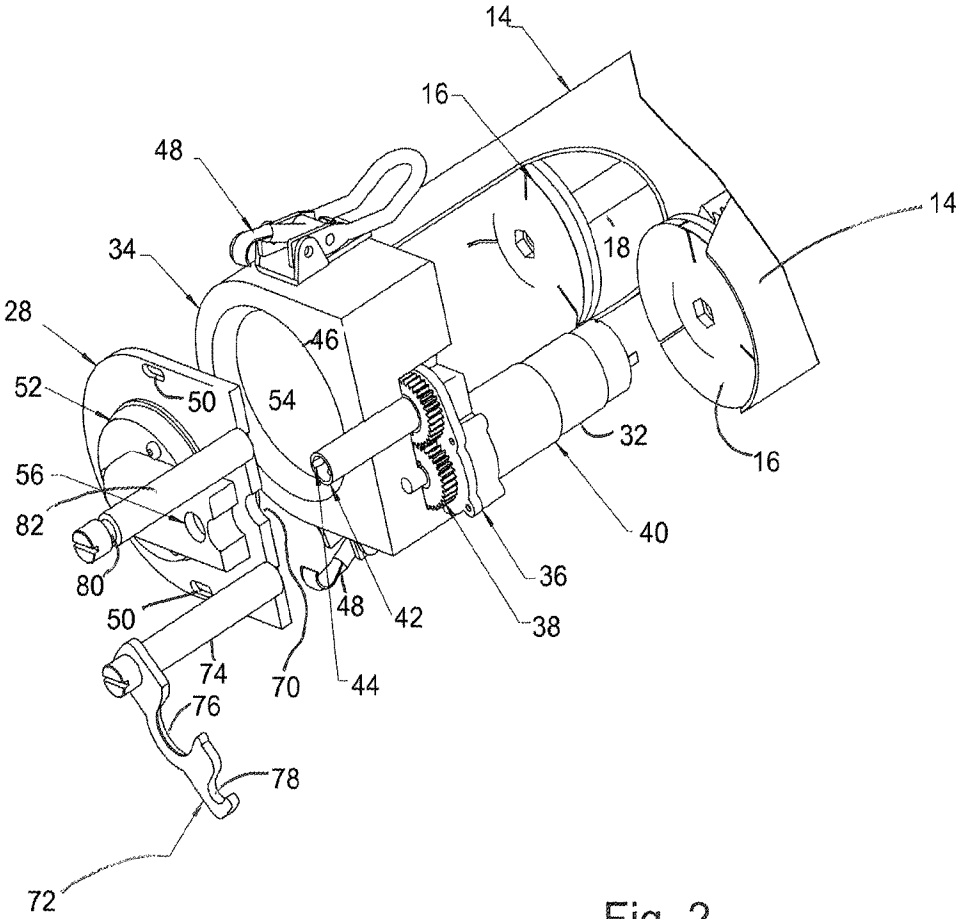
FIG. 2 illustrates a partially cut-away and exploded view of a front end of the dispenser.

With reference to FIG. 2, a motor mounting block 34 is secured to the barrels 14 at the front of the dispenser 2 and provides a mounting block for a motor mounting 36, which houses a spur gear set 38. The motor 32 is coupled to the spur gear set 38 by a planetary gearbox 40. An output drive shaft 42 is coupled to an output gear of the spur gear set 38 and provides a mating recess 44 at the front end thereof for coupling to the mixer attachment.

The coupling plate 28 is removably held against a sealing surface 46 of the motor mounting block 34 by four clamping toggles 48, which can engage respective recesses 50 to securely hold the coupling plate 28 against the motor mounting block 34 while sealing against the sealing surface 46. In the sealed configuration, the coupling plate 28 provides a conduit 52 for guiding flow from an outlet opening 54 of the barrel to a corresponding outlet opening 56 in the coupling plate. It will be understood that one conduit 52 and outlet 56 is provided for each barrel 14 and barrel outlet 54, that is two in the case described with reference to FIGS. 1 and 2.

Figure 3:
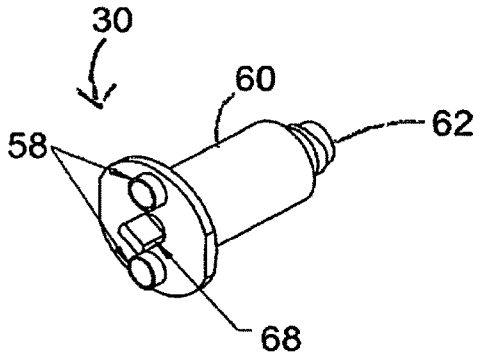
FIG. 3 illustrates a mixer attachment.
Figure 4:
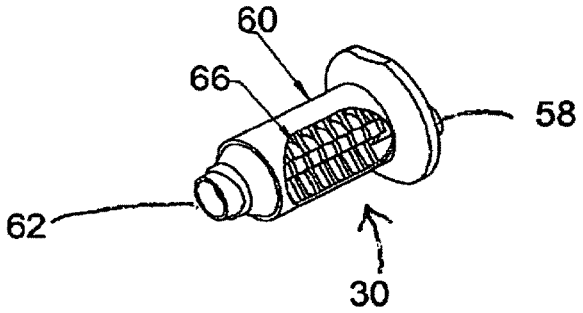
FIG. 4 illustrates a partially cut-away view of the mixer attachment.

With reference to FIGS. 3 and 4, the mixer attachment 30 provides a dynamic mixer for attachment to the dispenser 2 and comprises respective mixer inlets 58 for engaging a corresponding conduit outlet 56 each, a mixer housing 60 and mixer outlet 62. The mixer attachment provides a flow path from each of the mixer inlets 58 to a common volume inside the mixer housing 60 where the materials from each of the mixer inlets 58 are mixed and then dispensed through the mixer outlet 62. Inside the mixer housing a plurality of mixer components 66 are disposed around a mixer shaft coupled to a mixer drive dog 68. A torque applied to the drive dog 68 causes rotation of the shaft and hence the mixer component 66, causing the mixer components to mix (stir) together the materials from each of the mixer inlets flowing through the volume inside the mixer housing 60.

Returning to FIG. 2, the coupling plate 28 defines an aperture 70 through which the drive shaft 42 passes when the coupling plate is secured in place. To engage with the mixer attachment 30 held by the coupling plate 28, the mating recess 44 of the drive shaft 42 engages the drive dog 68, enabling the motor 32 to drive the mixer components 66 inside the mixer housing 60, thereby vigorously mixing the materials inside the mixer housing. The conduit outlets 56 are disposed in a mating arrangement with the mixer inlets 58, so that the mixer inlets 58 sealingly engage the conduit outlets 56 when the mixer attachment 30 is attached. To hold the mixer attachment 30 securely in place, a mixer retaining plate 72 is provided rotatably on a post 74 extending forward from the coupling plate 28 and has a first recess 76 for engagement with a neck of the mixer attachment 30 to hold the mixer attachment 30 in place and a second recess 78 for engaging a corresponding feature 80 on a second pole 82 extending forward from the coupling plate 28. With the mixer retaining plate 72 engaging both the neck of the mixer attachment 30 and the feature 80, the mixer attachment 30 is securely held in place.

The dispenser 2 comprises a controller (not shown) for controlling the operation of the motors 10 and 32 in response to actuation of triggers 24 and 26 by a user. Trigger 24 is coupled to a potentiometer, so that actuation of the trigger 24 generates a command signal related to the degree to which the trigger 24 is depressed. In response to this control signal, the controller controls the motor 10 to turn with a variable speed as a function of the control signal, so that the dispensing speed of the dispenser 2 can be controlled by a degree to which the trigger 24 is depressed. The controller also controls the motor 32 in response to depression of the trigger 24. In contrast to the motor 10, the motor 32 is not controlled to rotate at a velocity corresponding to the degree of depression of the trigger 24 but rather is simply turned on to mix dispensed material when the trigger 24 is started to be depressed and turned off when the trigger 24 is not pressed anymore to mix any dispensed material. Control of the motor 32 may be a simply on off switch, or the motor may be controlled to rotate at a fixed speed and/or generating a fixed torque, or simply be controlled by supply with a fixed current voltage.

In operation, each of the barrels 14 is loaded with a respective material in a foil pack and the coupling plate 28 is secured to the motor mounting block 34 by means of the clamping toggles 48. Typically, the materials will form a two (or more) component adhesive or sealant when dispensed and mixed together. A mixer attachment 30 is attached to the coupling plate 28 and held in place by means of the mixer retainer plate 72 being engaged. To dispense and mix the materials, the user depresses the trigger 24 to a desired degree and for a desired amount of time to dispense a desired amount of materials at a desired speed. Actuation of the trigger causes the motor 10 to drive the plunger 16 into the barrels 14, resulting in a dispensing pressure which causes flow of the materials through the respective conduits 52 into the mixer housing 60 where they are mixed by rotation of the mixer components 66 rotating inside the mixer housing 60. When it is desired to retract the plungers, for example to change the foil packs inside the barrels 14, a user depresses the trigger 26 until reverse rotation of the motor has caused the plungers 16 to retract sufficiently.

While a specific example of an embodiment has been described, it will be appreciated that many operations, alterations and juxtapositions of the features described above are possible and will readily be apparent to the person skilled in the art and that, accordingly, the above description is made by way of example and not limitation.

For example, the described embodiment can readily be adapted to other number of materials to be mixed, for example three or four. Further, while an embodiment with sealed barrels and materials in respective foil packs has been described above, it will be appreciated that the sealed barrels as material holders can be replaced with a holder for a cartridge combining two or more barrels holding respective materials and providing respective outlets for engagement with the mixer attachment.

Various constructional details can also be varied. For example, other securing arrangements than the clamping toggle described above are equally possible, for example sliding arrangements or arrangements in which the coupling plate is held in place by threaded nuts. It will also be appreciated that the configuration of the drive dog and mating recess can be inversed so that the recess is provided on the mixer attachment 30 and the drive dog on the drive shaft 42. Evidently, other arrangements for coupling the drive shaft to the mixer attachment are equally possible.

Regarding the control of the two separate motors discussed above, it is equally envisaged that both motors could be operated with variable speed or with a fixed speed. Equally either or both motors may be operated using a different control scheme, for example one or both could be operated with fixed current, or variable flux, voltage or torque control, as appropriate. Thus, any combination of the same or different control schemes for the two motors is possible, subject to the application constraints.

What is claimed:

1. A dispenser for mixing and dispensing a multi-component adhesive or sealant, the dispenser comprising:

a dispensing mechanism for dispensing the materials;

a holder portion for holding the materials relative to the dispensing mechanism;

a stock portion coupled to the holder and defining a handle portion to enable a user to hold the dispenser by griping the handle, thereby to operate the dispenser as a hand-held dispenser;

a first electric motor coupled to the dispensing mechanism to drive the dispensing mechanism;

a mixer holder for holding a mixer attachment relative to the holder portion to receive the materials for mixing inside a mixer;

a mixing mechanism for coupling to the mixer attachment when the mixer attachment is attached to the mixer holder;

a second electric motor coupled to the mixing mechanism by a planetary gearbox and a gear set for driving the mixer attachment when the mixer attachment is attached to the mixer holder; and a controller configured to control the first electric motor as a variable speed motor based on a magnitude of a user input and to control the second electric motor as a fixed speed motor by switching the second motor on and off based on the presence of the user input.

2. A dispenser as claimed in claim 1, wherein the first electric motor is housed by the stock portion.

3. A dispenser as claimed in claim 2, wherein the holder is coupled to the stock portion at a first end and is coupled or coupleable to the mixer holder at a second, opposed end and the second motor is secured to the holder adjacent the second end.

4. A dispenser as claimed in claim 3, wherein the mixer holder can be removeably secured to the holder portion and the mixing mechanism engages a mixer attachment secured to the mixer holder when the mixer holder is secured to the holder portion.

5. A dispenser as claimed in claim 1, wherein the holder portion is configured to accommodate one or more cartridges together defining two or more barrels containing the materials to be mixed.

6. A dispenser as claimed in claim 1, wherein the holder portion defines two or more barrels for containing the viscous materials.

7. A dispenser as claimed in claim 5, wherein the dispensing mechanism comprises two or more plungers driveable by the first electric motor into respective ones of the two or more barrels.

8. A dispenser as claimed in claim 5, wherein the mixer holder is arranged to sealingly engage the barrels and defines respective material conduits to connect each barrel with a corresponding outlet port for engaging respective mixer attachment inlets.

9. A dispenser as claimed in claim 1, wherein the mixer holder is removeably secured to the holder portion.

10. A dispenser for dispensing a mixture of viscous materials, the dispenser comprising:

a stock portion defining a handle to enable a user to hold the dispenser by gripping the handle, thereby to operate the dispenser as a hand-held dispenser;

a holder portion secured to the stock portion to hold the materials in respective barrels relative to the stock portion;

a first electric motor housed by the stock portion;

a dispensing mechanism coupled to the first electric motor to dispense the materials from the holder portion;

a mixer holder securable to the holder portion to guide the materials from their barrels to a respective outlet port for fluidically coupling to inlet ports of a mixer attachment; and a second electric motor coupled to the mixer by a planetary gearbox and a gear set, when the mixer attachment is attached to the outlet ports, to actuate the mixer attachment; and a controller configured to control the first electric motor as a variable speed motor based on a magnitude of a user input and to control the second electric motor as a fixed speed motor by switching the second motor on and off based on the presence of the user input.

11. A dispenser as claimed in claim 10, wherein the second electric motor is disposed adjacent the mixer holder.

12. A dispenser as claimed in claim 10, in combination with a mixer having one or more mixer components moveable inside the mixer attachment to mix a material in the mixer attachment, wherein the mixer components can be driven by the second electric motor when the mixer attachment is coupled to the dispenser.

13. A dispenser for dispensing a mixture of viscous materials, the dispenser comprising:

a dispensing mechanism for dispensing the materials;

a holder portion for holding the materials relative to the dispensing mechanism;

a stock portion coupled to the holder and defining a handle portion to enable a user to hold the dispenser by gripping the handle, thereby to operate the dispenser as a hand-held dispenser;

a first electric motor coupled to the dispensing mechanism to drive the dispensing mechanism;

a mixer holder for holding a mixer attachment relative to the holder portion to receive the materials for mixing inside a mixer;

a mixing mechanism for coupling to the mixer attachment when the mixer attachment is attached to the mixer holder;

a second electric motor coupled to the mixing mechanism by a planetary gearbox and a gear set for driving the mixer attachment when the mixer attachment is attached to the mixer holder; and a controller configured to operate the first electric motor as a variable speed motor based on magnitude of a user operational input and to operate the second electric motor as a fixed speed motor upon the presence of user input.

* * * * *